US010657781B2

(12) United States Patent
Chen et al.

(10) Patent No.: US 10,657,781 B2
(45) Date of Patent: May 19, 2020

(54) SMART DOORBELL

(71) Applicant: CHICONY ELECTRONICS CO., LTD., New Taipei (TW)

(72) Inventors: Chien-Yueh Chen, New Taipei (TW); Jin-Kae Jang, New Taipei (TW); Mei-Yi Tsai, New Taipei (TW)

(73) Assignee: CHICONY ELECTRONICS CO., LTD., New Taipei (TW)

( * ) Notice: Subject to any disclaimer, the term of this patent is extended or adjusted under 35 U.S.C. 154(b) by 0 days.

(21) Appl. No.: 16/233,760

(22) Filed: Dec. 27, 2018

(65) Prior Publication Data

US 2020/0126376 A1 Apr. 23, 2020

(30) Foreign Application Priority Data

Oct. 23, 2018 (TW) ..... 107137388 A

(51) Int. Cl.
*G08B 13/02* (2006.01)

(52) U.S. Cl.
CPC ..... *G08B 13/02* (2013.01)

(58) Field of Classification Search
CPC ..... G08B 13/02; G08B 13/06; G08B 13/08; G08B 13/1654; G08B 13/194
USPC .... 340/540, 541, 42, 565, 566, 568.1, 693.5
See application file for complete search history.

(56) References Cited

U.S. PATENT DOCUMENTS 6,774,807 B1 * 8/2004 Lehfeldt ..... G08B 29/046 324/110
2009/0038019 A1 * 2/2009 Tatai ..... G07F 9/02 726/34
2015/0070495 A1 * 3/2015 Scalisi ..... H04M 1/0291 348/143
2016/0300476 A1 * 10/2016 Kasmir ..... H04M 1/0291

* cited by examiner

*Primary Examiner* — Brian Wilson
(74) *Attorney, Agent, or Firm* — Muncy, Geissler, Olds & Lowe, P.C.

(57) ABSTRACT

A smart doorbell includes a case set, a circuit board, a lens, a vibration sensing module, a locking unit, a vibration unit and a vibration transferring unit. The case set includes a first case and a second case. The first case is combined with the second case. The circuit board is located in the case set. The lens is disposed on the circuit board. The vibration sensing module is connected to the circuit board. The locking unit locks the first case and the second case. The vibration unit is connected to the locking unit and includes a plurality of crests and a plurality of troughs. The crests and troughs are aligned alternatingly. The vibration transferring unit touches the vibration unit.

15 Claims, 5 Drawing Sheets

SMART DOORBELL

BACKGROUND OF THE INVENTION

1. Field of the Invention

The present invention relates to a smart doorbell; more particularly, the present invention relates to a smart doorbell with an anti-theft function.

2. Description of the Related Art

With the development of the computer and network technology, and people's pursuit of home equipment having multiple functions, smart home appliances have become a popular focus of research and development. A smart home appliance is a home appliance with network and data search functions to collect and integrate the home environment information anytime and anywhere; the user can control the smart home appliance remotely, or the smart home appliance can work automatically. One of the most popular smart home appliances is the smart doorbell.

The smart doorbell is a doorbell with cloud and network technology. The smart doorbell can be electrically connected to the smartphone of the user such that the user can use the smartphone to immediately respond to a guest in front of the user's home. The smart doorbell can also provide a remote monitoring function such that the user can check the situation in front of the user's home anytime. However, to disable the remote monitoring function of the smart doorbell, some thieves maliciously disassemble the case of the smart doorbell to damage the electronic components of the smart doorbell and thereby disable the network or remote monitoring function of the smart doorbell; thus, the thieves can enter the user's home without being monitored.

Therefore, there is a need to provide a new smart doorbell which has an anti-theft function to solve the abovementioned problem.

SUMMARY OF THE INVENTION

It is an object of the present disclosure to provide a smart doorbell with an anti-theft function.

To achieve the abovementioned object, a smart doorbell of the present disclosure includes a case set, a circuit board, a lens, a vibration sensing module, a locking unit, a vibration unit and a vibration transferring unit. The case set includes a first case and a second case, and the first case is combined with the second case. The circuit board is located in the case set. The lens is disposed on the circuit board. The vibration sensing module is connected to the circuit board. The locking unit locks the first case and the second case. The vibration unit is connected to the locking unit and includes a plurality of crests and a plurality of troughs. The crests and the troughs are aligned alternatingly. The vibration transferring unit contacts the vibration unit. When the locking unit rotates, the locking unit causes the vibration unit to rotate such that the vibration transferring unit moves back and forth on the plurality of crests and the plurality of troughs to generate a vibration, and the vibration sensing module senses the vibration.

According to one embodiment of the present invention, the smart doorbell further includes an alarm module, and the alarm module is electrically connected to the vibration sensing module.

According to one embodiment of the present invention, the vibration transferring unit includes a moving unit and an elastic unit. The vibration transferring unit contacts the vibration unit via the moving unit, and the vibration transferring unit is connected to the circuit board. The elastic unit is connected to the moving unit.

According to one embodiment of the present invention, the vibration transferring unit further includes a containing tube, and the elastic unit is located in the containing tube. One end of the containing tube is connected to the circuit board, and the moving unit is located at the other end of the containing tube.

According to one embodiment of the present invention, the vibration sensing module receives a shaking image captured by the lens to determine the vibration.

According to one embodiment of the present invention, the vibration sensing module receives a regularly shaking image captured by the lens to determine the vibration.

According to one embodiment of the present invention, the moving unit is a sphere, and the elastic unit is a spring.

According to one embodiment of the present invention, the vibration transferring unit includes a moving unit, an elastic unit, and a containing tube, and the vibration transferring unit is connected to the circuit board; the elastic unit is connected to the moving unit and located in the containing tube.

According to one embodiment of the present invention, when the locking unit rotates, the locking unit causes the vibration unit to rotate, and an elastic force of the elastic unit moves the moving unit, allowing the moving unit to move back and forth on the crests and the troughs to generate the vibration.

According to one embodiment of the present invention, the vibration transferring unit transfers the vibration to the circuit board, allowing the lens to shake and capture a shaking image; the vibration sensing module senses the vibration by receiving the shaking image.

According to one embodiment of the present invention, the vibration transferring unit includes a moving unit and an elastic unit, one end of the moving unit is pivotally connected to the case set, and the other end of the moving unit contacts the vibration unit; the elastic unit is connected to the moving unit.

According to one embodiment of the present invention, one end of the elastic unit is connected to the moving unit, and the other end of the elastic unit is connected to the vibration sensing module.

According to one embodiment of the present invention, the moving unit is a sheet, and the elastic unit is a spring.

According to one embodiment of the present invention, the vibration transferring unit includes a moving unit and an elastic unit, one end of the moving unit is pivotally connected to the first case, and the other end of the moving unit contacts the vibration unit; one end of the elastic unit is connected to the moving unit, and the other end of the elastic unit is connected to the vibration sensing module.

According to one embodiment of the present invention, the elastic unit transfers the vibration to the vibration sensing module, allowing the vibration sensing module to sense the vibration.

According to one embodiment of the present invention, the case set includes a hole, and the lens is exposed through the hole.

According to one embodiment of the present invention, the locking unit is a screw.

According to one embodiment of the present invention, the crests and the troughs are aligned alternatingly along a circumference direction of the locking unit.

According to one embodiment of the present invention, the vibration unit is connected to a top of the locking unit, and in a shape as a gear.

BRIEF DESCRIPTION OF THE DRAWINGS

These and other objects and advantages of the present invention will become apparent from the following description of the accompanying drawings, which disclose several embodiments of the present invention. It is to be understood that the drawings are to be used for purposes of illustration only, and not as a definition of the invention.

In the drawings, wherein similar reference numerals denote similar elements throughout the several views.

DETAILED DESCRIPTION OF THE PREFERRED EMBODIMENT

Figure 1:
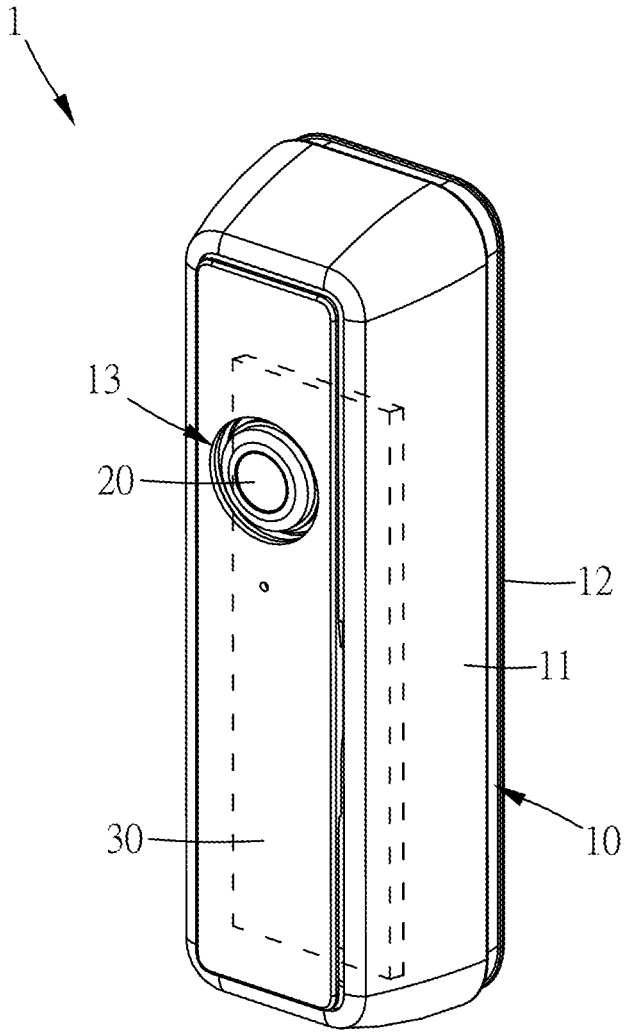
FIG. 1 illustrates a schematic drawing of the smart doorbell in the first embodiment of the present invention.
Figure 2:
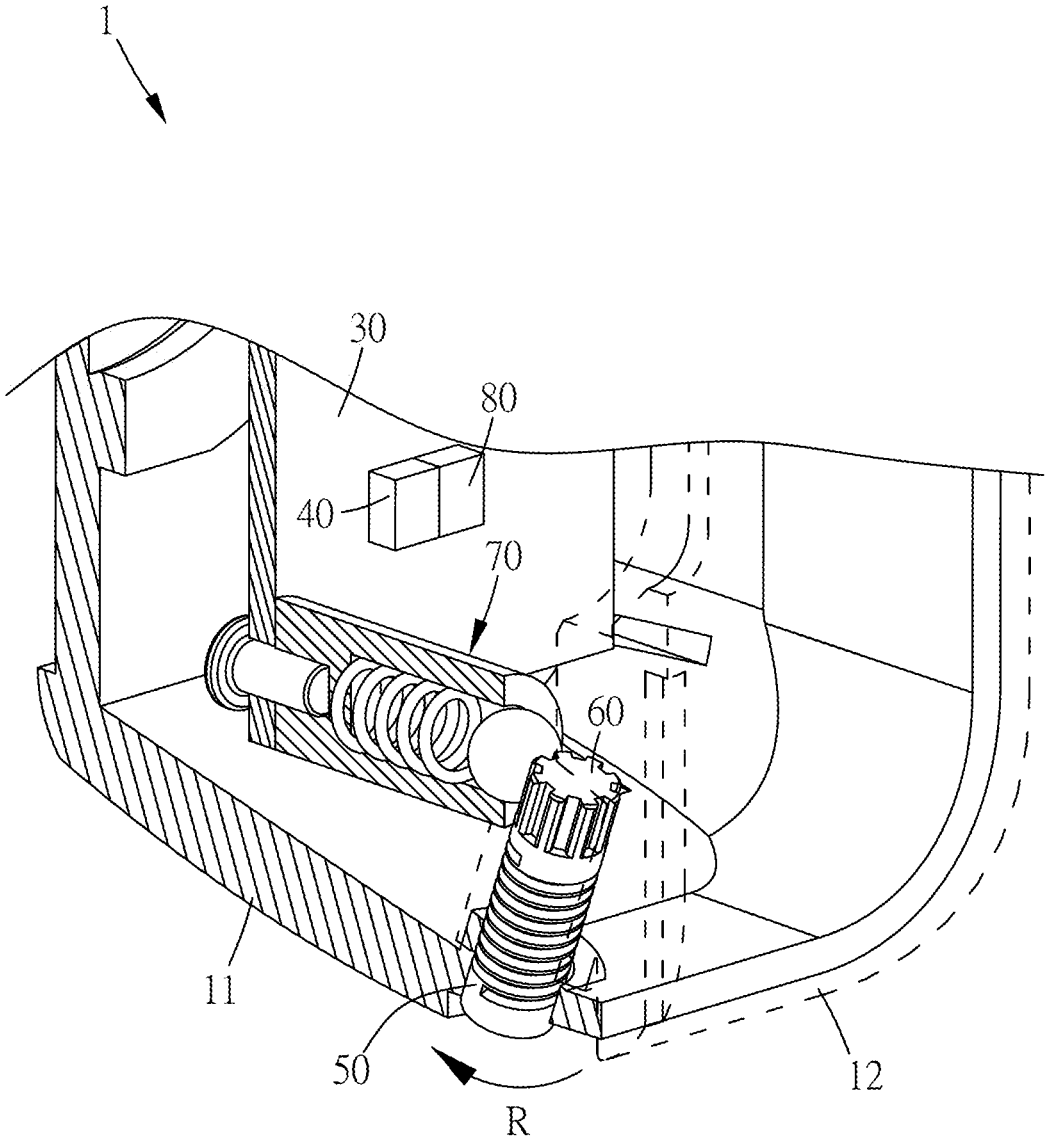
FIG. 2 illustrates a partial sectional view of the smart doorbell in the first embodiment of the present invention.
Figure 3:
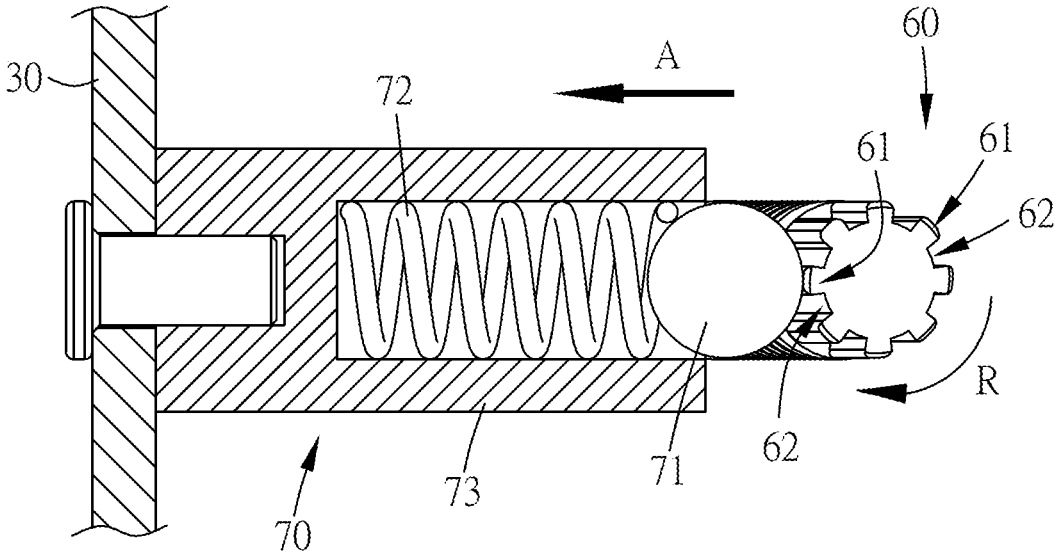
FIG. 3 illustrates a schematic drawing of the vibration unit rotated such that one of the crests contacts the moving unit in the first embodiment of the present invention.
Figure 4:
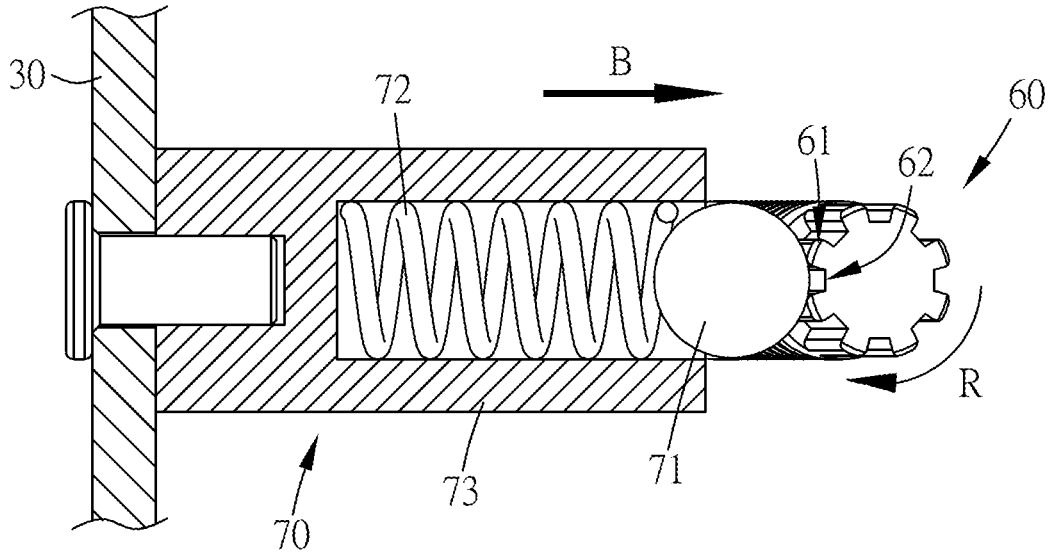
FIG. 4 illustrates a schematic drawing of the vibration unit rotated such that the moving unit is located on one of the troughs in the first embodiment of the present invention.
Figure 5:
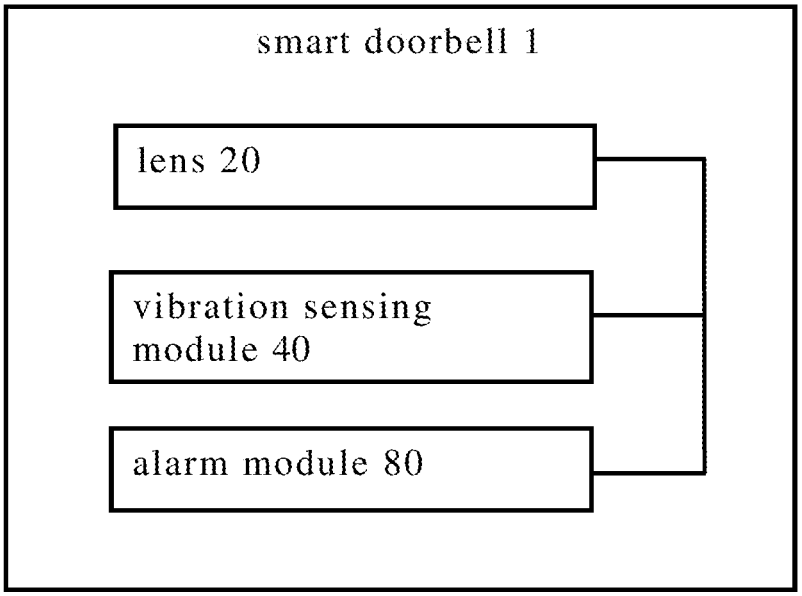
FIG. 5 illustrates a system structure drawing of the smart doorbell in the first embodiment of the present invention.

Please refer to FIG. 1 to FIG. 5, which illustrate the smart doorbell in the first embodiment of the present invention. FIG. 1 illustrates a schematic drawing of the smart doorbell in the first embodiment of the present invention. FIG. 2 illustrates a partial sectional view of the smart doorbell in the first embodiment of the present invention. FIG. 3 illustrates a schematic drawing of the vibration unit rotated such that one of the crests contacts the moving unit in the first embodiment of the present invention. FIG. 4 illustrates a schematic drawing of the vibration unit rotated such that the moving unit is located on one of the troughs in the first embodiment of the present invention. FIG. 5 illustrates a system structure drawing of the smart doorbell in the first embodiment of the present invention.

In the first embodiment of the present invention, as shown in FIG. 1, FIG. 2 and FIG. 5, the smart doorbell 1 has the anti-theft function, and the smart doorbell 1 can generate an alert when a person maliciously disassembles the smart doorbell 1. The smart doorbell 1 includes a case set 10, a lens 20, a circuit board 30, a vibration sensing module 40, a locking unit 50, a vibration unit 60, a vibration transferring unit 70 and an alarm module 80.

In the first embodiment of the present invention, the case set 10 includes a first case 11, a second case 12 and a hole 13. The first case 11 is the case towards outside, and the second case 12 is the case which is attached to the wall (wherein the second case 12 is shown with dotted lines in FIG. 2). The first case 11 is combined with the second case 12. The hole 13 is located in the first case 11.

In the first embodiment of the present invention, the lens 20 is disposed on the circuit board 30, and the lens 20 is electrically connected to the vibration sensing module 40 and the alarm module 80. The lens 20 is exposed to the outside of the case set 10 through the hole 13 to capture an image of the outside of the case set 10. The circuit board 30 is located inside the case set 10. The vibration sensing module 40 is connected to the circuit board 30. The vibration sensing module 40 can receive the image captured by the lens 20 and determine if there is a vibration by checking if the image captured by the lens 20 shakes.

The locking unit 50 locks the first case 11 and the second case 12. If there is a need to disassemble the case set 10, the locking unit 50 must be rotated to release the locking between the locking unit 50, the first case 11 and the second case 12. In the first embodiment of the present invention, the locking unit 50 is a screw. If there is a need to open the case set 10, a user may use a screwdriver to rotate the screw of the locking unit 50 to release the locking among the locking unit 50, the first case 11 and the second case 12.

In the first embodiment of the present invention, as shown in FIG. 2 to FIG. 4, the vibration unit 60 is connected to the top of the locking unit 50. The vibration unit 60 includes a plurality of crests 61 and a plurality of troughs 62. The crests 61 and the troughs 62 are aligned alternatingly along a circumference direction of the locking unit 50, and in a shape as a gear. When the locking unit 50 rotates, the locking unit 50 will cause the vibration unit 60 to rotate.

In the first embodiment of the present invention, the vibration transferring unit 70 contacts the vibration unit 60. The vibration transferring unit 70 includes a moving unit 71, an elastic unit 72 and a containing tube 73. The moving unit 71 is a sphere, and the vibration transferring unit 70 contacts the vibration unit 60 via the moving unit 71. The elastic unit 72 is a spring. The elastic unit 72 is connected to the moving unit 71 and located in the containing tube 73. The elastic force of the elastic unit 72 can push the moving unit 71 such that the moving unit 71 moves along the moving direction B shown in FIG. 4. One end of the containing tube 73 of the vibration transferring unit 70 is connected to the circuit board 30, and the moving unit 71 is located at the other end of the containing tube 73.

In the first embodiment of the present invention, as shown in FIG. 2 and FIG. 5, the alarm module 80 is disposed on the circuit board 30 and electrically connected to the vibration sensing module 40. The alarm module 80, as a specific example, is a network module connected to a police station or security agency server. When the vibration sensing module 40 senses a vibration, the vibration sensing module 40 will send a signal to the alarm module 80, and the alarm module 80 will then notify the police station or security agency.

In the first embodiment of the present invention, as shown in FIG. 2, if a thief wants to disassemble the case set 10 to damage the electronic components in the case set 10, the thief may use a screwdriver to rotate the locking unit 50 along the rotation direction R shown in FIG. 2. When the locking unit 50 rotates along the rotation direction R, the locking unit 50 will cause the vibration unit 60 to rotate along the rotation direction R along with the locking unit 50; as shown in FIG. 3, as the vibration unit 60 rotates along the rotation direction R, if one of the crests 61 displaces the moving unit 71, the moving unit 71 will move along the moving direction A shown in FIG. 3 and the elastic unit 72 will be compressed and deformed to provide an elastic force to push the moving unit 71; then, as shown in FIG. 4, since the moving unit 71 is pushed by the elastic unit 72, if the vibration unit 60 keeps rotating along the rotation direction R such that the crest 61 shifts, the moving unit 71, which is pushed, will move along the moving direction B and fall onto the trough 62 next to the shifting crest 61; then, if the vibration unit 60 keeps rotating along the rotation direction R, another adjacent crest 61 will displace the moving unit 71 such that the moving unit 71 moves along the moving direction A (which means that the vibration transferring unit 70 returns to the state shown in FIG. 3); thus, during the process of the vibration unit 60 rotating along the rotation direction R, the moving unit 71 moves back and forth on the crests 61 and the troughs 62 to generate a vibration. More particularly, during the process of the vibration unit 60 rotating along the rotation direction R, the moving unit 71 moves back and forth along the moving direction A and the moving direction B to generate the vibration.

The vibration generated by the back-and-forth movement of the moving unit 71 is transferred to the circuit board 30 via the elastic unit 72 and the containing tube 73 to cause the lens 20 on the circuit board 30 to shake regularly. Therefore, the shaking lens 20 will capture a shaking image, and the vibration sensing module 40 receives the shaking image captured by the lens 20. The vibration sensing module 40 can sense the vibration by receiving the shaking image. When the vibration sensing module 40 determines that there is a vibration, the vibration sensing module 40 will send a signal to the alarm module 80, and the alarm module 80 will then notify the police station or security agency. By this design, the police station or security agency will be alerted that someone is disassembling the case set 10 and the police station or security agency can execute a corresponding security action to achieve the anti-theft function.

It is to be known that, although wind or rain can also cause the lens 20 or the circuit board 30 to shake slightly in random directions, during the process of the vibration unit 60 of the present invention rotating along the rotation direction R, the back-and-forth movement of the moving unit 71 on the plurality of crests 61 and the plurality of troughs 62 will generate a regular vibration, not a random vibration; thus, the vibration sensing module 40 of the present invention can be further designed to determine that the vibration is generated when the shaking image captured by the lens 20 shakes regularly, and to send the signal to the alarm module 80, to prevent the random shaking caused by wind or rain from being mistaken as shaking caused by a thief disassembling the case set 10 and thus to prevent accidental triggering of the anti-theft function.

Furthermore, since wind or rain may only cause the circuit board 30 or the lens 20 to shake slightly (in the practical experiments performed by the applicant of this invention, the common wind and rain caused the circuit board 30 generate shaking with an amplitude of 0.1 mm) in random directions, the vibration sensing module 40 of the present invention can be further designed such that the following conditions apply: If the shaking amplitude of the image captured by the lens 20 is more than 1 mm, and the shaking direction of the image captured by the lens 20 is in the moving directions A, B, the vibration sensing module 40 will determine that there is a vibration and send the signal to the alarm module 80, to prevent the random shaking caused by wind or rain from being mistaken as shaking caused by a thief disassembling the case set 10 and thus to prevent accidental triggering of the anti-theft function. However, the shaking amplitude threshold of the image is not limited to 1 mm; it can be changed according to design requirements.

Furthermore, if a maintenance worker of the smart doorbell 1 needs to open the case set 10 to repair the electronic components, the smart doorbell 1 can also be designed to provide a safe removal mechanism such that the maintenance worker can disassemble the case set 10 without triggering the anti-theft function. For example, the alarm module 80 can provide a temporary shutdown mode; if the maintenance worker accesses the smart doorbell 1 via the network and inputs a specific password, the alarm module 80 will execute the temporary shut-down mode to shut down for a specific time. By this design, the maintenance worker can disassemble the case set 10 within that specific time without triggering the anti-theft function.

Figure 6:
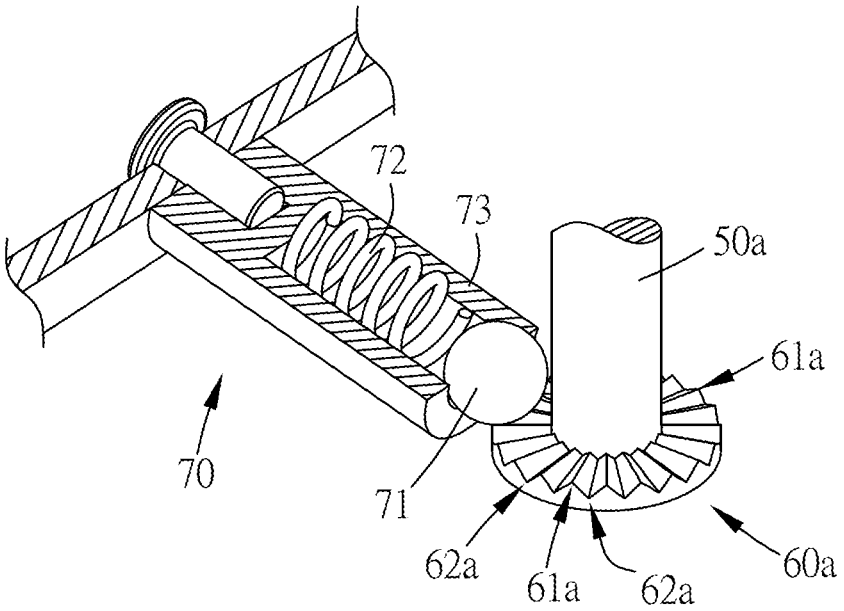
FIG. 6 illustrates a schematic drawing of the vibration unit contacting the vibration transferring unit in the second embodiment of the present invention.

Please refer to FIG. 6, which illustrates the smart doorbell in the second embodiment of the present invention. FIG. 6 illustrates a schematic drawing of the vibration unit contacting the vibration transferring unit in the second embodiment of the present invention.

As shown in FIG. 6, the difference between the second embodiment and the first embodiment is that, in the second embodiment, the vibration unit 60*a* includes the plurality of crests 61*a* and the plurality of troughs 62*a*. The crests 61*a* and the troughs 62*a* of the vibration unit 60*a* are aligned alternatingly and in a shape as a radial disc, and the radial disc is located on the bottom of the locking unit 50*a*. When the locking unit 50*a* rotates, the moving unit 71 will move back and forth on the plurality of crests 61*a* and the plurality of troughs 62*a* on the radial disc to generate a vibration.

Figure 7:
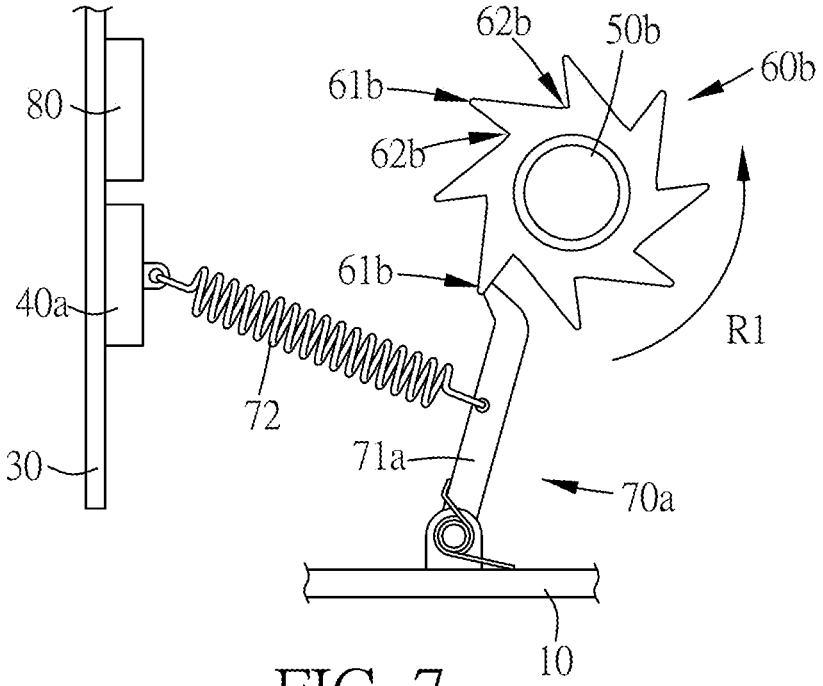
FIG. 7 illustrates a schematic drawing of the vibration unit contacting the vibration transferring unit in the third embodiment of the present invention.

Please refer to FIG. 7, which illustrates the smart doorbell in the third embodiment of the present invention. FIG. 7 illustrates a schematic drawing of the vibration unit contacting the vibration transferring unit in the third embodiment of the present invention.

As shown in FIG. 7, the difference between the third embodiment and the first embodiment is described below. When the case set is being disassembled, the locking unit 50*b* rotates along the counterclockwise rotation direction R1 show in FIG. 7. The vibration unit 60*b* is connected to the top of the locking unit 50*b* and includes the plurality of crests 61*b* and the plurality of troughs 62*b*. The crests 61*b* and the troughs 62*b* of the vibration unit 60*b* are aligned alternatingly and in a shape as a radical star-shaped structure. The vibration transferring unit 70*a* includes a moving unit 71*a* and an elastic unit 72, but the vibration transferring unit 70*a* does not include the containing tube; the moving unit 71*a* is a sheet, one end of the moving unit 71*a* is pivotally connected to the case set 10, and the other end of the moving unit 71*a* contacts the vibration unit 60*b*. The elastic unit 72*a* is still a spring. One end of the elastic unit 72 is connected to the moving unit 71*a*, and the other end of the elastic unit 72 is connected to the vibration sensing module 40*a*. In the third embodiment, the vibration sensing module 40*a* is a piezoelectric sensor.

When the locking unit 50*b* rotates along the rotation direction R1, the locking unit 50*b* will cause the vibration unit 60*b* to rotate; one of the crests 61*b* which contacts the moving unit 71*a* will move the moving unit 71*a*; when the vibration unit 60*b* keeps rotating such that the crest 61*b* leaves the moving unit 71*a*, the elastic force of the elastic unit 72 will pull the sheet of the moving unit 71*a* such that the sheet of the moving unit 71*a* crosses the adjacent trough 62*b* and contacts the adjacent crest 61*b*. By this design, the moving unit 71*a* can move back and forth on the plurality of crests 61*b* and the plurality of troughs 62*b*; more particularly, during the process of the vibration unit 60*b* rotating along the rotation direction R1, the moving unit 71*a* will swing back and forth, and the moving unit 71*a* will pull the elastic unit 72 to generate a vibration. The elastic unit 72 will transfer the vibration to the piezoelectric sensor of the vibration sensing module 40*a* such that the vibration sensing module 40 senses the vibration and sends the signal to the alarm module 80.

By the design of the smart doorbell 1 of the present invention, the smart doorbell 1 has an anti-theft function. When people maliciously disassemble the case set of the smart doorbell 1, the vibration unit and the vibration transferring unit will be triggered to generate the vibration. By this design, the vibration sensing module will sense the vibration and alert a police station or security service.

What is claimed is:

1. A smart doorbell, comprising:

a case set, comprising a first case and a second case, wherein the first case is combined with the second case;

a circuit board, located in the case set;

a lens, disposed on the circuit board;

a vibration sensing module, connected to the circuit board;

a locking unit, locking the first case and the second case;

a vibration unit, connected to the locking unit, and comprising a plurality of crests and a plurality of troughs, wherein the plurality of crests and the plurality of troughs are aligned alternatingly; and a vibration transferring unit, contacting the vibration unit, wherein the vibration transferring unit comprises a moving unit and an elastic unit, one end of the moving unit is pivotally connected to the first case of the case set, the other end of the moving unit contacts the vibration unit, one end of the elastic unit is connected to the moving unit, and the other end of the elastic unit is connected to the vibration sensing module;

wherein when the locking unit rotates, the locking unit causes the vibration unit to rotate such that the vibration transferring unit moves back and forth on the plurality of crests and the plurality of troughs to generate a vibration, and the vibration sensing module senses the vibration.

2. The smart doorbell as claimed in claim 1, further comprising an alarm module, wherein the alarm module is electrically connected to the vibration sensing module.

3. The smart doorbell as claimed in claim 2, wherein the vibration transferring unit is connected to the circuit board, and the elastic unit is connected to the moving unit.

4. The smart doorbell as claimed in claim 2, wherein when the locking unit rotates, the locking unit causes the vibration unit to rotate, and an elastic force of the elastic unit moves the moving unit, allowing the moving unit to move back and forth on the plurality of crests and the plurality of troughs to generate the vibration.

5. The smart doorbell as claimed in claim 4, wherein the vibration transferring unit transfers the vibration to the circuit board, allowing the lens to shake and capture a shaking image; the vibration sensing module senses the vibration by receiving the shaking image.

6. The smart doorbell as claimed in claim 1, wherein the vibration sensing module receives a shaking image captured by the lens to sense the vibration.

7. The smart doorbell as claimed in claim 1, wherein the vibration sensing module receives a regularly shaking image captured by the lens to sense the vibration.

8. The smart doorbell as claimed in claim 1, wherein the elastic unit is a spring.

9. The smart doorbell as claimed in claim 1, wherein the moving unit is a sheet, and the elastic unit is a spring.

10. The smart doorbell as claimed in claim 1, wherein when the locking unit rotates, the locking unit causes the vibration unit to rotate, and an elastic force of the elastic unit moves the moving unit, allowing the moving unit to move back and forth on the plurality of crests and the plurality of troughs to generate the vibration.

11. The smart doorbell as claimed in claim 10, wherein the elastic unit transfers the vibration to the vibration sensing module, allowing the vibration sensing module to sense the vibration.

12. The smart doorbell as claimed in claim 1, wherein the case set comprises a hole, and the lens is exposed through the hole.

13. The smart doorbell as claimed in claim 1, wherein the locking unit is a screw.

14. The smart doorbell as claimed in claim 1, wherein the plurality of crests and the plurality of troughs are aligned alternatingly along a circumference direction of the locking unit.

15. The smart doorbell as claimed in claim 1, wherein the vibration unit is connected to a top of the locking unit, and in a shape as a gear.

* * * * *